United States Patent [19]

Lotz

[11] Patent Number: 4,730,464

[45] Date of Patent: Mar. 15, 1988

[54] REFRIGERATOR AND FREEZER

[75] Inventor: Helmut Lotz, Giengen, Fed. Rep. of Germany

[73] Assignee: Bosch-Siemens Hausgeräte GmbH, Munich, Fed. Rep. of Germany

[21] Appl. No.: 941,635

[22] Filed: Dec. 15, 1986

[30] Foreign Application Priority Data

Dec. 16, 1985 [DE] Fed. Rep. of Germany ..... 3544445

[51] Int. Cl.[4] ..... F25D 9/00

[52] U.S. Cl. ..... 62/401; 62/275; 165/54; 165/101

[58] Field of Search ..... 62/93, 401, 402, 275; 165/54, 101

[56] References Cited

U.S. PATENT DOCUMENTS

| | | | |
|---|---|---|---|
| 2,496,602 | 2/1950 | Schlichtig | 62/94 |
| 2,997,131 | 8/1961 | Fisher | 62/275 |
| 3,692,096 | 9/1972 | Petterson et al. | 165/101 |
| 3,868,827 | 3/1975 | Lindharot et al. | 62/401 |
| 4,295,518 | 10/1981 | Rannenberg | 62/401 |

FOREIGN PATENT DOCUMENTS 470100 12/1950 Canada .

*Primary Examiner*—Ronald C. Capossela

*Attorney, Agent, or Firm*—Herbert L. Lerner; Laurence A. Greenberg

[57] ABSTRACT

A refrigeration apparatus includes a cooling chamber having a given useful space therein, and a cold generator having a cold air loop connected to the cooling chamber for cooling the given useful space, the cold air loop including a compressing device, a heat exchanger disposed downstream of the compressing device and exposed to the ambient air for cooling air drawn from the useful space with a relatively high temperature level almost to the temperature of the ambient air after compression, cooling device downstream of the heat exchanger, an expansion device downstream of the cooling device, the air being returned to the useful space after subsequent expansion and corresponding cooling below the lowest temperature level, and an additional heat exchanger for dehumidifying the circulated air current in the loop, the additional heat exchanger including heat exchanger surfaces, air drawn from the cooling chamber being dried from the upper temperature level with the aid of expanded cold air by the of condensation of absorbed moisture on the heat exchanger surfaces.

6 Claims, 6 Drawing Figures

REFRIGERATOR AND FREEZER

The invention relates to a refrigerator or freezer, especially an upright household refrigerator or freezer, the useful space of which is cooled by a cold generator of the cold air loop or circuit type, wherein air drawn from the useful space with a higher temperature level is cooled after compression in a heat exchanger exposed to the ambient air almost drawn to the temperature of the ambient air and the air is returned to the useful space after subsequent expansion and corresponding cooling to a temperature below the lowest temperature level, the loop having a device for dehumidification of the circulated air.

In refrigerators and freezers of the above-mentioned type, the atmospheric air used as a working medium is circulated in an open loop. Since the air can therefore absorb water vapor from its surroundings and from the refrigerated or frozen products, ice cyrstals form during the low temperatures prevailing after the expansion stage. This poses the danger of the crystals precipitating after the expansion stage and of the crystals settling in the form of rime or ice, causing the function of the cold air loop to be greatly impaired.

In prior art refrigerators or freezers of the type mentioned above, labyrinth or cyclone extractors are provided, with which the ice crystals occurring after the expansion stage are extracted from the air current. The extracted ice crystals are then thawed and are removed from the system in the form of melted water.

However, as long as an expansion turbine is used as the expansion stage, the creation of rime cannot be controlled. Since it depends, for example, on the number of germs in the circulated air, the local supercooling, the local flow conditions, the air temperature and the humidity of the air, it is possible for ice crystals to already be formed within the blade rim of the expansion turbine, which is different from the usual case in which they only occur afterwards, because of their finite growth speed. If compact ice crystals develop which are moved with a high relative speed, the danger exists of such crystals leading to mechanical stresses and to damage to the rotor blades as well as to the guide vanes of the expansion turbine.

It is accordingly an object of the invention to provide a refrigerator and freezer which overcomes the hereinaforementioned disadvantages of the heretofore-known devices of this general type.

With the foregoing and other objects in view there is provided, in accordance with the invention, a refrigeration apparatus, comprising a cooling chamber having a given useful space therein, and a cold generator having a cold air loop connected to the cooling chamber for cooling the given useful space, the cold air loop including compressing means, a heat exchanger disposed downstream of the compressing means and exposed to the ambient air for cooling air drawn from the useful space with a relatively high temperature level almost to the temperature of the ambient air after compression, cooling means downstream of the heat exchanger, expansion means downstream of the cooling means, the air being returned to the useful space after subsequent expansion and corresponding cooling below the lowest temperature level, and an additional heat exchanger for dehumidifying the circulated air current in the loop, the additional heat exchanger including heat exchanger surfaces and means for drying air drawn from the cooling chamber from the upper temperature level with the aid of expanded cold air by means of condensation of absorbed moisture on the heat exchanger surfaces.

With the aid of the additional heat exchanger inserted into the loop, it is assured that the circulated air only reaches the expansion turbine in a dried state, so that ice crystals can no longer be formed there.

In accordance with another feature of the invention, the additional heat exchanger is a cross-current plate heat exchanger including vertically disposed plates, a lower end manifold and a drain for melted water.

A considerable simplification results if, in accordance with a further feature of the invention the lower end manifold of the cross-current plate heat exchanger is inclined downward toward the drain.

An especially simple means for shortening the defrosting time results if, in accordance with an added feature of the invention, there is provided a heater for defrosting the plates of the cross-current plate heat exchanger.

In accordance with an additional feature of the invention, the cross-current plate heat exchanger includes an insulated wall thermally separating the cross-current plate heat exchanger into two compartments, and means for selectively connecting the compartments to the cold air loop carrying the air current.

This permits a continuous operation of the refrigerator and freezer according to the invention in a simple manner.

In accordance with a concomitant feature of the invention, the connecting means are in the form of control flaps for regulating the path of the air currents through the compartments of the cross-current plate heat exchanger.

Other features which are considered as characteristic for the invention are set forth in the appended claims.

Although the invention is illustrated and described herein as embodied in a refrigerator and freezer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
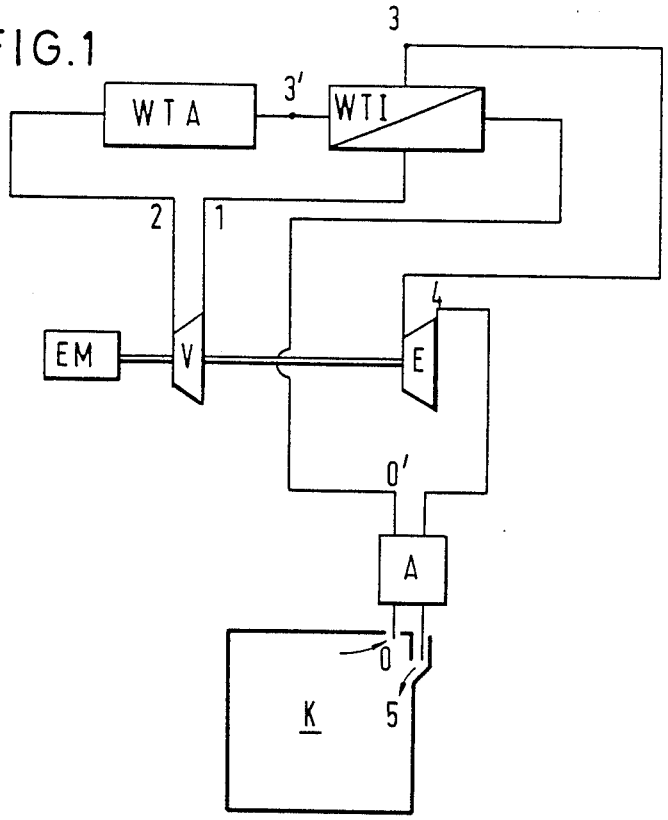
FIG. 1 is a schematic circuit diagram of a cold air loop or circuit for a freezer with an additional heat exchanger according to the invention.

Referring now to the figures of the drawings in detail and first, particularly, to FIG. 1 thereof, there is seen a cooling chamber of a freezer designated with reference symbol K, the freezer having a heat-insulated housing closable by a non-illustrated door in the usual manner. The freezer is equipped with a cold generator or refrigerator of the cold air loop or circuit type which can be operated continuously or intermittently. During intermittent operation, the air temperature in the cooling chamber K rises during the off-time of the cold generator. This is the result of the entry of heat from the exterior through the heat insulation of the housing, the entry of outside air when the door is opened and, last but not least, the entry of heat energy brought by frozen products freshly deposited into the cooling chamber K.

If the air temperature inside the freezer climbs to the upper switch-on point of a non-illustrated thermostat, the circuit for a drive motor EM during a combined turbine pair formed of a high-speed compression turbine V and an expansion turbine E, is closed. Air in a state 0 is drawn from the inner space of the freezer K and is guided through an additional heat exchanger A, where its state is changed to a state 0' in a manner which is described below.

Figure 2:
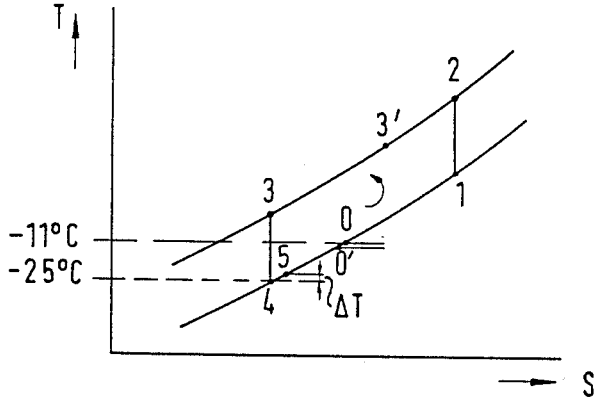
FIG. 2 is a T/S diagram of the ideal thermo-dynamic operation of the cold air loop with the additional heat exchanger.
Figure 3:
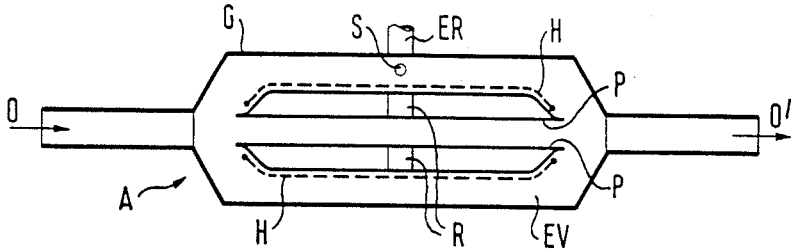
FIGS. 3 to 5 are different diagrammatic, elevational views of a first embodiment of the additional heat exchanger constructed in the form of a simple cross-current plate heat exchanger.
Figure 4:
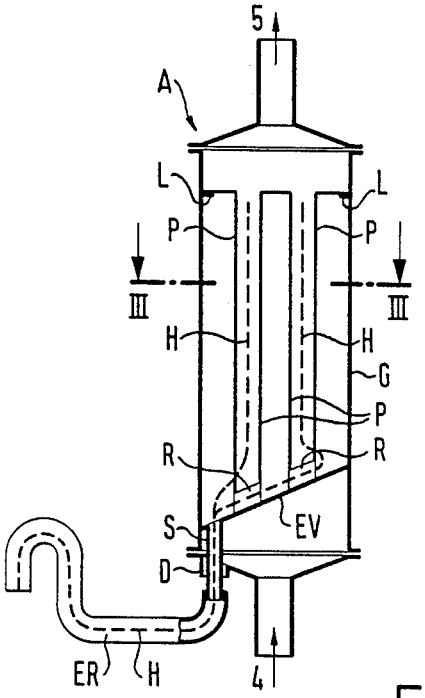
Figure 5:
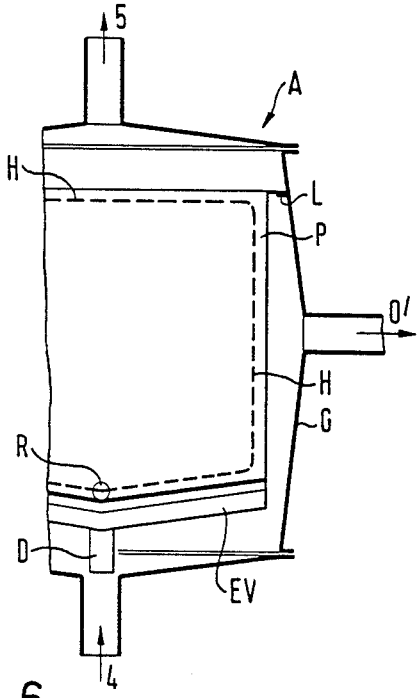

In the state 0' the air is then guided across the cold side of an interior heat exchanger WTI. Air in a state 1 flows from the interior heat exchanger WTI and reaches the compression turbine V, from where it is guided in a state 2 into an exterior heat exchanger WTA which is exposed to room temperature. In the exterior heat exchanger WTA exposed to room temperature, the temperature of the compressed air is lowered to a state 3' above the room temperature. The different states of the air which change as it passes through the several phases and which are designated by numbers, correspond to states according to the T/S (Temperature/Entropy) diagram shown in FIG. 2.

The air leaves the exterior heat exchanger WTA in the state 3' and enters the interior heat exchanger WTI on the warm side, where an exchange of heat with the air drawn from the freezer and brought to the state 0' in the additional heat exchanger A takes place. In the interior heat exchanger WTI, the temperature of the air is lowered to the state 3.

In the state 3 the air is drawn from the interior heat exchanger WTI by the expansion turbine E and the air is expanded in the expansion turbine E to a state 4, whereby its temperature is lowered to approximately −25 degrees C. The cold air in a state 5 returns to the freezer K through the additional heat exchanger A.

In the additional heat exchanger A, a heat exchange occurs between the warm air drawn from inside the freezer K in the state 0 and the extremely cold air in the state 4 coming from the expansion turbine E. The moisture absorbed by the air in the state 0 inside the freezer K condenses in the form of rime or frozen fog in the additional heat exchanger A, so that the air leaves the heat exchanger in a dried condition in the state 0'. In this manner an uncontrolled formation of rime or ice crystals in or after the expansion turbine E is avoided with certainty, since the air can be dehumidified from the state 0 nearly to the dew point temperature at the state 4 with a corresponding construction of the heat exchanger A.

The additional heat exchanger A is constructed in the form of a cross-current plate heat exchanger with an exterior housing G and plates P disposed upright therein, as seen in FIGS. 3 to 6.

The warmer and moister air coming from the usable space of the freezer K in the state 0 flows through the additional heat exchanger A, which is constructed in the form of an collector, filter or separator. The air comes in contact with the cold plates P which have hollow spaces through which the cold air stream flows downstream of the expansion turbine E in the state 4 which has been created. In the additional heat exchanger the moisture absorbed by the air in the freezing chamber condenses in the form of rime on the walls of the plates P, where the air is cooled to the state 0' and is dehumidified. The cold air streaming in in the state 4 is warmed to the state 5, in which state it is blown into the usable space.

The plates P are welded or rolled-in into end manifolds EV as sheet metal walls and are hung in support straps L in a practical manner. However, no great demands are made on tightness, since the pressure of the air in the states 0 and 4 is almost identical.

Disposed on the edges of the plates which can also be welded or rolled-in, are electrical heating wires H which are appropriately conducted to the outside through a drain S at the bottom and from there through drain pipes ER.

After melting, the moisture extracted in the state 0 from the air stream in the form of rime runs off through channels D, which are extended a little above the lower end manifold EV, that is situated at an angle in order to facilitate runoff of water and penetrates the plates P, into a through pipe R penetrating the end manifold plate P at the lowest point of the plate pocket. Furthermore, a flexible hose which may be in the form of a siphon that is heatable by the electrical heating wires H, is connected with the through pipe R, in order to conduct water through a trap and through the siphon into a non-illustrated evaporator plate, in order to let it evaporate again.

The defrosting operation can be time-controlled, or it can be started when a certain pressure drop in the air stream from the state 0 to 0' is exceeded, or it can be started by an optical-sensory control of the thickness of the rime. The cold generator is then switched off and the electrical heating wires H are switched on. The end of the defrosting operation is either time-controlled or it is controlled by measuring the surface temperature of the plates P when the freezing point is exceeded by switching off the defrosting heating wires H.

Figure 6:
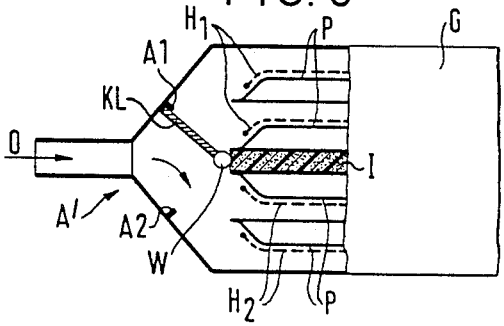
FIG. 6 is a partially broken away elevational view of a second embodiment of a cross-current plate heat exchanger controllable by flaps, as an alternative to the embodiment shown in FIGS. 3 to 5.

In the alternative embodiment of the additional heat exchanger A' which is broken away and therefore only half of which is shown in FIG. 6, a periodically defrostable collector, filter or separator is provided, wherein control flaps KL have been disposed on both inlet and outlet sides of the air, in contrast to the embodiment described above. In accordance with FIG. 6, the collector is formed of a shaft drive W, which can move the control flaps KL back and forth between two stops A1 and A2.

In the illustrated embodiment, the air coming from the useable space of the freezer K streams through the lower air conduits in the state 0 and is cooled and dehumidified by the cold air in the state 4 streaming in the opposite direction through the cold air conduits of the plates P. In the upper compartment, an electrical heater H1 is turned on, so that defrosting takes place in this compartment. In order to avoid a heat transfer between the two compartments, an insulating element I has been disposed between the two halves of the device, which also prevents the passage of air at the level of the plane of the shaft drive W. The reversing flap KL, which is made from a material with poor heat conducting properties and which abuts the stop A1 in the illustrated embodiment, prevents the passage of air through the other half, which is defrosting.

When this half has been defrosted under the control of a thermal sensor or after a period of time, for example, the electrical heater H1 is turned off, is switched over with a set time delay to the air side and the electrical heater H2 is switched on. The operation is thus continued cyclically. In any event, in this case heating of the drain pipes can also be accomplished by means of the warm air pipeline, since it has to be in constant operation to keep the drain S free of ice.

A reversing flap is also disposed in the other non-illustrated half of the cross-current plate heat exchanger and is moved in an analogous but opposite way to that described above.

The foregoing is a description corresponding in substance to German Application No. P 35 44 445.2, dated Dec. 16, 1985, the International priority of which is being claimed for the instant application, and which is hereby made part of this application. Any material discrepancies between the foregoing specification and the aforementioned corresponding German application are to be resolved in favor of the latter.

I claim:

1. Refrigeration apparatus, comprising a cooling chamber having a given useful space therein, and a cold generator having a cold air loop connected to said cooling chamber for cooling said given useful space, said cold air loop including compressing means, a heat exchanger disposed downstream of said compressing means and exposed to the ambient air for cooling air drawn from said useful space with a relatively high temperature level almost to the temperture of the ambient air after compression, cooling means downstream of said heat exchanger, expansion means downstream of said cooling means, the air being returned to said useful space after subsequent expansion and corresponding cooling below the lowest temperature level, and an additional heat exchanger for dehumidifying the circulated air current in said loop, said additional heat exchanger including heat exchanger surfaces and means for drying air drawn from said cooling chamber from the upper temperature level with the aid of expanded cold air by means of condensation of absorbed moisture on said heat exchanger surfaces.

2. Refrigeration apparatus according to claim 1, wherein said additional heat exchanger is a cross-current plate heat exchanger including vertically disposed plates, a lower end manifold and a drain for melted water.

3. Refrigeration apparatus according to claim 2, wherein said lower end manifold of said cross-current plate heat exchanger is inclined downward toward said drain.

4. Refrigeration apparatus according to claim 2, including a heater for defrosting said plates of said cross-current plate heat exchanger.

5. Refrigeration apparatus according to claim 2, wherein said cross-current plate heat exchanger includes an insulating wall thermally separating said cross-current plate heat exchanger into two compartments, and means for selectively connecting said compartments to said cold air loop carrying the air current.

6. Refrigeration apparatus according to claim 5, wherein said connecting means are in the form of control flaps for regulating the path of the air currents through said compartments of said cross-current plate heat exchanger.

* * * * *